United States Patent [19]

Young

[11] Patent Number: 4,950,351

[45] Date of Patent: Aug. 21, 1990

[54] LABEL APPLIER

[75] Inventor: William P. Young, Southfield, Mich.

[73] Assignee: William P. Young Company, Farmington, Mich.

[21] Appl. No.: 401,063

[22] Filed: Aug. 31, 1989

[51] Int. Cl.[5] ..... B65B 61/00

[52] U.S. Cl. ..... 156/475; 156/479

[58] Field of Search ..... 156/475, 468, 477.1, 156/479, 486–488, 492

[56] References Cited

U.S. PATENT DOCUMENTS

| | | | |
|---|---|---|---|
| 2,667,909 | 2/1954 | Stobb | 156/479 X |
| 4,004,962 | 1/1977 | Kleid | 156/479 X |
| 4,032,386 | 6/1977 | Fleet | 156/475 |
| 4,181,561 | 1/1980 | Seragnoli | 156/475 X |

*Primary Examiner*—David Simmons

*Attorney, Agent, or Firm*—Brooks & Kushman

[57] ABSTRACT

A label applier (20) for applying labels to box ends includes a horizontal conveyor (36), a label dispenser (44) that adhesively secures a label (22) to an upper side surface of each box end upon conveyance along the conveyor with a flap (22') of the label extending from the box end, an end presser (50) for pressing the label flap against the end surface of the box, and an inclined support (52) that mounts the end presser (50) for upward movement along the direction of conveyance to permit the end presser to ride over the box after the label pressing operation. The end presser (50) preferably includes a slide (54) and also includes a presser member (56) pivotally mounted on the slide. This presser member (56) preferably has a curved foot (62) that provides the engagement as the end presser rides over the box. An adjustable stop (64) controls positioning of the presser member (56) prior to the pressing of the label flap. A lower presser (92) preferably embodied by a roller (94) provides pressing of the label flap against a lower side surface of the box such that the label extends over the entire box end.

15 Claims, 5 Drawing Sheets

Fig. 2

LABEL APPLIER

TECHNICAL FIELD

This invention relates to a label applier for applying labels to box ends.

BACKGROUND ART

Label appliers have previously been developed to apply labels to box ends in order to seal the boxes and also provide indicia of the contents, the manufacturer, shipping instructions etc. Such label appliers have not been readily adaptable for use with different size boxes of various widths and heights at their ends. As such, the application of labels to box ends is more expensive than would be the case if it were possible to apply to labels to different size box ends with the same label applier.

DISCLOSURE OF INVENTION

An object of the present invention is to provide an improved label applier for applying labels to box ends.

In carrying out the above object, a label applier constructed in accordance with the present invention applies labels to box ends having spaced side and end surfaces and includes a horizontal conveyor for conveying the boxes horizontally while positioning the side surfaces thereof at upper and lower positions and one end surface thereof in a forward orientation with respect to the direction of conveyance. A label dispenser of the label applier applies an adhesively secured label to the upper side surface of each box upon conveyance along the conveyor with a flap of the label extending forwardly from the box a predetermined distance. An end presser of the label applier presses the label flap against the forward end surface of the box, and an inclined support of the label applier mounts the end presser for upward movement along the direction of box conveyance to permit the end presser to ride over the box after pressing the label against the end surface.

Mounting of the end presser by the inclined support permits the application of labels to boxes of different heights between their side surfaces and thereby provides the capability of labeling different size boxes with the same label applier.

In the preferred construction of the label applier, the end presser includes a slide mounted by the inclined support and also includes a presser member having a pivotal connection for providing mounting thereof on the slide. This presser member preferably includes a curved foot that engages the upper side surface of the box as the end presser rides over the box after pressing the label flap against the forward end surface.

The slide of the end presser also preferably includes a stop that positions the presser member in an inclined position in preparation for each label flap pressing operation and during the movement of the end presser over the box after the label flap pressing. This stop most preferably includes an adjustable stop member for permitting adjustment of the degree of inclination of the presser member.

In the preferred construction, the slide of the end presser includes a vertically extending slide member having an upper end mounted by the inclined support and a lower end on which the presser member is pivotally mounted. An intermediate portion of the vertically extending slide member mounts the adjustable stop which is engaged by the curved foot of the presser member to control the inclination of the presser member.

The label applier also preferably has its inclined support provided with a vertically adjustable mount for adjusting the vertical positioning of the end presser. While certain smaller variations in the heights of box ends to which labels are to be applied can be accommodated for by the degree of movement of the end presser along the inclined support, greater variations of the box heights are readily accommodated for by this vertically adjustable mount which positions the end presser in the appropriate location for different heights of the box ends to which labels are to be applied.

The label applier is also preferably constructed to apply labels to the upper side surface of from a greater distance than the height of the box end surface such that the label flap extends downwardly from the box after the end presser presses the label flap against the forward end surface. A lower presser of the label applier presses the downwardly extending label flap against the lower side surface of the box after the pressing by the end presser. As such, the lower presser cooperates with the label dispenser and with the end presser mounted on the inclined support to provide application of a label to both side surfaces and the end surface of the box. In its preferred construction, the lower presser comprises a roller over which the box is conveyed by the conveyor of the label applier. Also, the lower presser roller most preferably has a rotatable support that permits lateral adjustment of the roller to accommodate for boxes of different widths.

In the preferred construction disclosed, the label applier has its horizontal conveyor provided with: (a) an infeed conveyor that feeds the boxes to the label dispenser; (b) an operating conveyor that conveys each box past the label applier, the end presser, and the lower presser roller; and (c) an outfeed conveyor that delivers the labeled box. The horizontal conveyor also preferably includes a pair of laterally spaced conveyor sections that are laterally adjustable to accommodate boxes of different widths and thereby cooperates with the laterally adjustable rotatable support of the lower presser roller in accommodating different box widths. The pair of adjustable conveyor sections also preferably include endless conveyor loops that drive the boxes in the direction of conveyance during the label applying operation.

The objects, features, and advantages of the present invention are readily apparent from the following description of the best mode when taken in connection with the accompanying drawings.

BEST MODE FOR CARRYING OUT THE INVENTION

Figure 1:
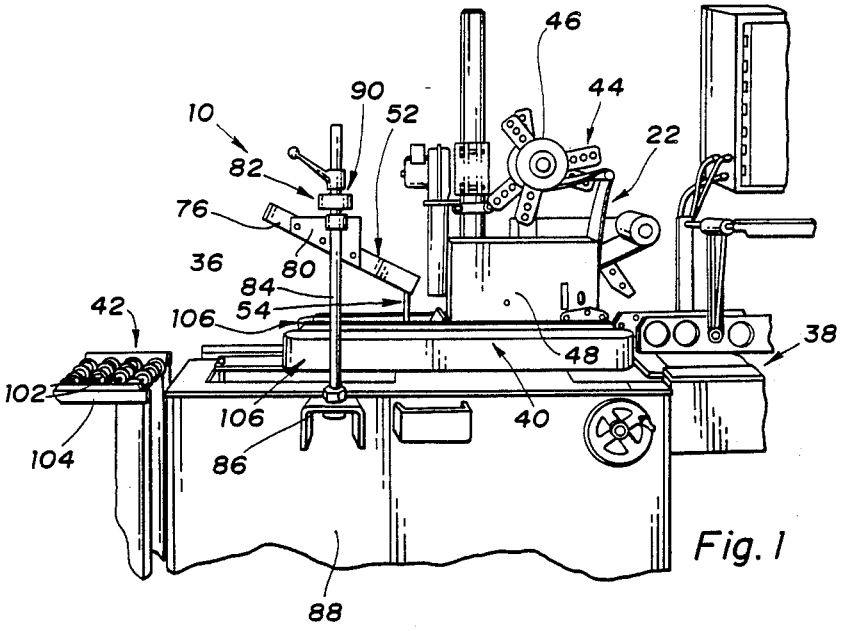
FIG. 1 is a side perspective view of a label applier constructed in accordance with the present invention.

As illustrated in FIG. 1 of the drawings, a label applier constructed in accordance with the present invention is generally indicated by 10 and operates to apply labels 22 to the ends 24 of boxes 26 as shown in FIGS. 2 through 6 as is hereinafter described. Each box end 24 has spaced side surfaces 28 and 30 and an end surface 32 as well as having lateral sides 34 between which the side surfaces 28 and 30 extend.

As illustrated in FIG. 1, the label applier 10 includes a horizontal conveyor 36 for conveying the boxes 26 horizontally while respectively positioning the side surfaces 28 and 30 thereof at upper and lower positions with one of the box end surfaces 32 in a forward orientation with respect to the direction of conveyance toward the left as illustrated. The horizontal conveyor 36 a is hereinafter more fully described preferably includes an infeed conveyor 38, an operating conveyor 40, and an outfeed conveyor 42 that convey the boxes from the right toward the left along the direction of conveyance during a label applying operation.

Figure 2:
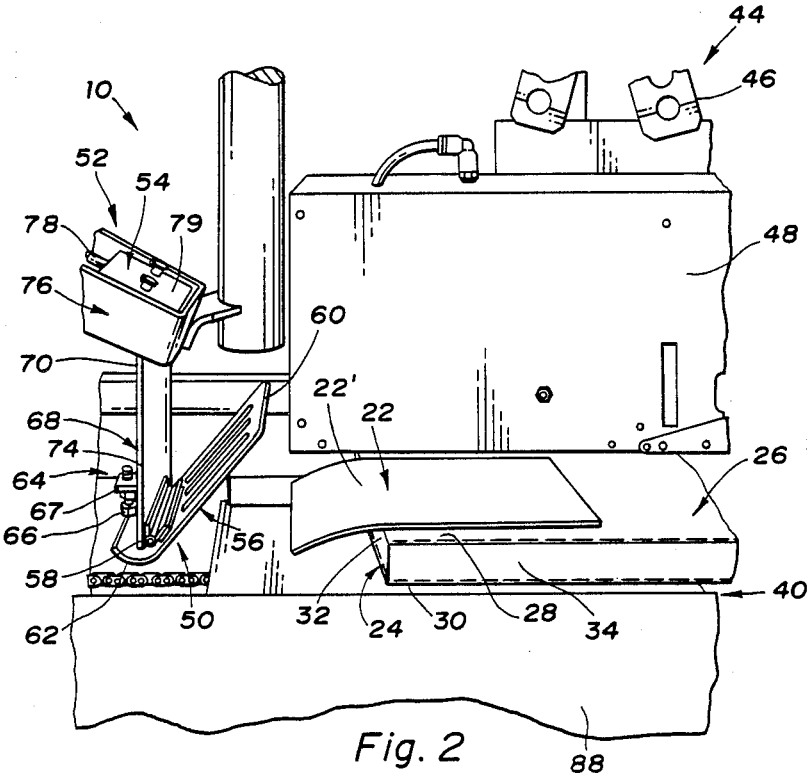
FIG. 2 is an enlarged view of a portion of the label applier illustrating the manner in which a label dispenser thereof applies an adhesively secured label to an upper side surface of the box end with a flap of the label extending forwardly from the box.

As also illustrated in FIG. 1, the label applier 10 includes a label dispenser 44 for feeding the labels 22 from a label spool 46 to a dispensing head 48 that initially applies each label 22 as illustrated in FIG. 2 to the upper side surface 28 of each box 26 upon conveyance along the conveyor with a flap 22' of the label extending forwardly from the box a predetermined distance along the direction of conveyance.

Figure 3:
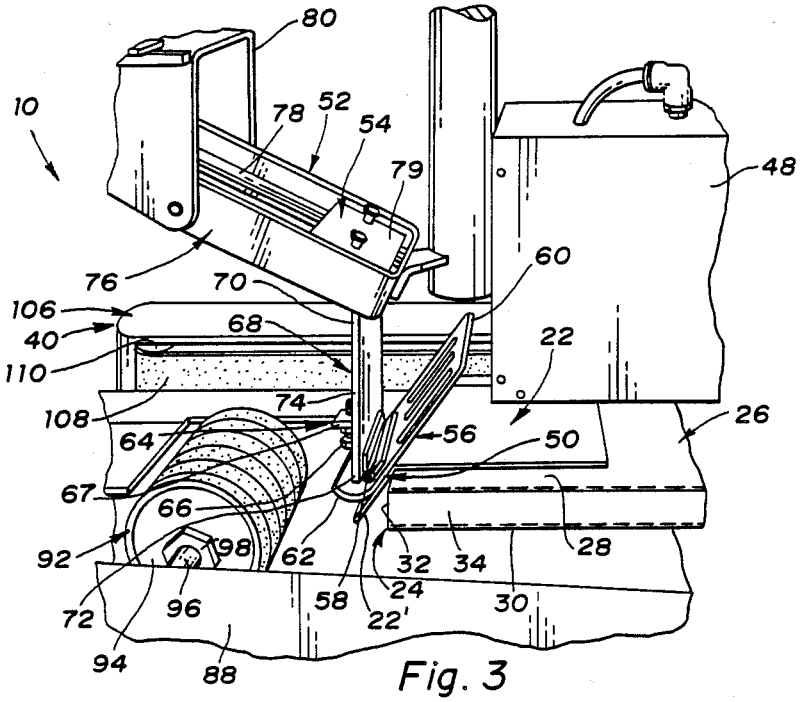
FIG. 3 is a view similar to FIG. 2 illustrating the manner in which an end presser of the label applier presses the label flap downwardly.
Figure 4:
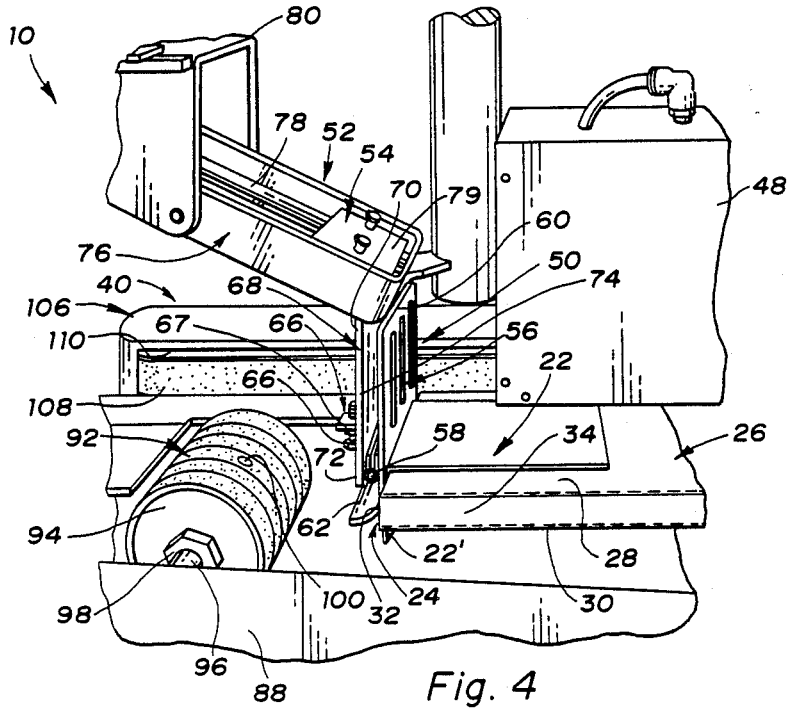
FIG. 4 is a view similar to FIG. 3 at a further stage illustrating the manner in which the end presser presses the label flap against an end surface of the box.

As illustrated by combined reference to FIGS. 2 through 4, the label applier 10 also includes an end presser 50 for pressing the label flap 22' against the end surface 32 of the box 26. An inclined support 52 of the label carrier is best illustrated in FIGS. 1, 3, and 4 and mounts the end presser 50 for upward movement in an inclined orientation along the direction of box conveyance to permit the end presser to ride over the box as shown in FIG. 6 after the pressing of the label against the end surface 32.

The construction of the label applier 10 discussed above permits application of labels to boxes with different heights between the upper and lower side surfaces 28 and 30. More specifically, the manner in which the end presser 50 is mounted by the inclined support 52 for movement in an inclined orientation along the direction of conveyance provided by the horizontal conveyor permits the label 22 supplied by the label dispenser to have its end flap 22' pressed against the box end surface 32 with the end presser 50 subsequently riding over the upper side surface 28 of the box as shown in FIG. 6.

In the preferred construction, the end presser 50 includes a slide 54 mounted by the inclined support 52 and also includes a presser member 56 having a pivotal connection 58 for providing mounting thereof on the slide. This presser member 56 preferably has a plate-like construction extending from the pivotal end 56 to an upper end 60 thereof as shown in FIGS. 2 and 3 and also preferably has a curved foot 62 that engages the upper side surface 28 of the box 26 as the end presser 50 rides over the box as shown in FIG. 6 after pressing the label flap 22' against the end surface 32.

Figure 6:
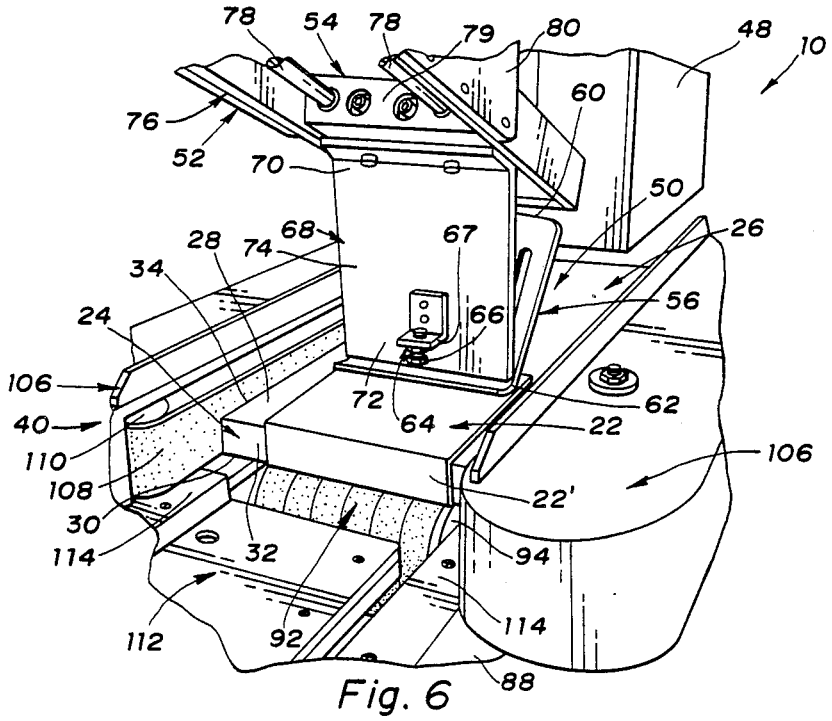
FIG. 6 is an end perspective view taken generally in the same direction as FIG. 5 at a later stage after the end presser is moved upwardly along the direction of conveyance along an inclined support to ride over the box after the label pressing against the box end surface and also illustrates a lower presser roller that presses the label flap against a bottom side surface of the box.

As shown in FIGS. 2 and 6, the slide 54 of the end presser 50 preferably includes a stop 64 that positions the presser member 56 in an inclined position in preparation for each label flap pressing operation as illustrated in FIG. 2 and during movement of the end presser over the box as illustrated in FIG. 6 after the label flap pressing. This stop 64 preferably includes an adjustable stop member 66 which is illustrated as being embodied by a bolt whose threaded shank is adjustably supported by a bracket 67 fixed on the slide. The head of this bolt engages the curved foot 62 of the presser member 56 at its upper extremity on the opposite side of the pivotal connection 58 from the upper end 60 of the plate-like construction of the presser member. A suitable lock nut secures the bolt stop member 66 in the adjusted position providing the correct angle of inclination of the presser member 56 between the pivotal connection 58 and its upper end 60.

As shown in FIGS. 2 through 6, the slide 54 of the end presser 50 includes a vertically extending slide member 68 that has a plate-like construction as illustrated. This slide member 68 has an upper end 70 mounted by the inclined support 32 as is hereinafter more fully described. A lower end 72 of the slide member 68 has the presser member 56 mounted thereon by the pivotal connection 58 which is illustrated as a hinge with a pair of pivotally interconnected leaf members respectively connected to the slide member and the presser member in any suitable manner. An intermediate portion 74 of the slide member 68 mounts the adjustable stop 64 which is engaged by the curved foot 62 of the presser member 56 to control the inclination of the presser member. More specifically, the plane of the plate-like slide member 68 extends transversely to the direction of conveyance and has the adjustable stop 64 mounted on its downstream side with respect to the direction of conveyance which is generally toward the left in FIGS. 2–4.

Figure 5:
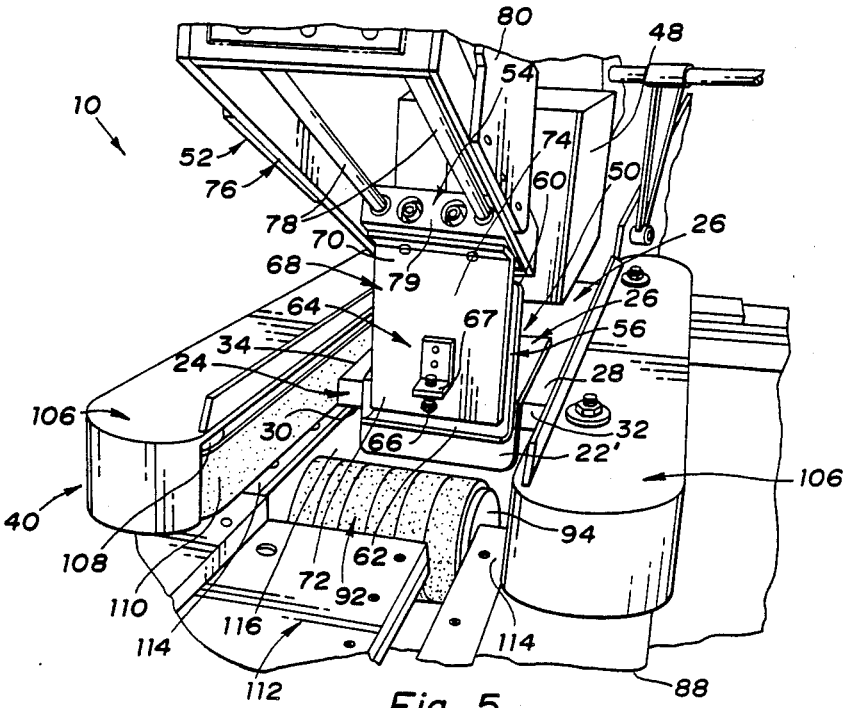
FIG. 5 is an end perspective view illustrating the label applier as the end presser presses the label flap against the box end surface as also illustrated in FIG. 4.

As illustrated in FIGS. 1, 3, and 5, the inclined support 52 includes a peripheral housing 76 of an elongated rectangular construction and also includes a pair of spaced and generally parallel slide rods 78 whose opposite ends are supported in a suitable manner by the longitudinal ends of the elongated housing. Slide 54 has an upper slide block 79 that is located within the housing 76 and which supports the upper end 70 of slide member 68. This slide block 79 is slidably supported by the rods 78 of the inclined support 52 to provide the upward movement in an inclined orientation along the direction of conveyance as previously discussed. An inverted U-shaped bracket 80 of the inclined support 52 is secured to the housing 76 at its opposite lateral sides generally intermediate its ends as shown in FIG. 1. A vertically adjustable mount 82 of any suitable construction adjusts the vertical position of the inclined support 52 to thereby also adjust the vertical position of the end presser. More specifically, this vertically adjustable mount 82 includes a vertical support member 84 whose lower end is mounted by a bracket 86 on the conveyor base 88 in an upwardly extending fashion with a suitable adjustable clamping mechanism 90 between the housing bracket 80 and the support member so as to permit the vertical adjustment. As is hereinafter more fully described, the mount 82 also provides lateral adjustment of the inclined support 52 to accommodate for boxes of different widths.

As illustrated in FIGS. 4 and 5, the label dispenser 44 applies the label 22 to the upper side surface 28 of the box 26 with the label flap 22' extending forwardly therefrom a greater distance than the height of the box end surface 32 such that the label flap 22' extends downwardly from the box after the end presser 50 presses the label flap against the end surface 32. A lower presser 92 of the label applier presses the label flap 22' against the lower side surface 30 of the box after the pressing by the end presser. More specifically, the lower presser 92 comprises a roller 94 that is rotatably mounted by the conveyor base 88 about a horizontal axis transverse to the direction of conveyance. The box 26 rolls over the roller 94 as the box conveyance continues below the end presser 50 as illustrated by FIG. 6. A shaft 96 has opposite ends supported by the conveyor base 88 as illustrated in FIG. 4 and has a pair of adjustment members 98 that provide positioning of the presser roller 94 along the length of the shaft in a lateral direction with respect to the direction of conveyance along the conveyor. An opening 100 (FIG. 4) in the presser roller 94 receives a suitable threaded lock screw that cooperates with the shaft 96 and adjustment members 98 to provide a rotatable support that permits the lateral adjustment of the roller while securing the roller in cooperation with adjustment members 98 in any laterally adjusted position for use in pressing the label flap against the lower side surface 30 of the box end.

As previously mentioned, the horizontal conveyor 36 illustrated in FIG. 1 includes the infeed conveyor 38 that feeds the boxes to the label dispenser 44, the operating conveyor 40 that moves each box during its label applying operation, and the outfeed conveyor 42 which includes rolls 102 mounted on a frame 104 to receive and convey the boxes after the label applying operation.

Figure 7:
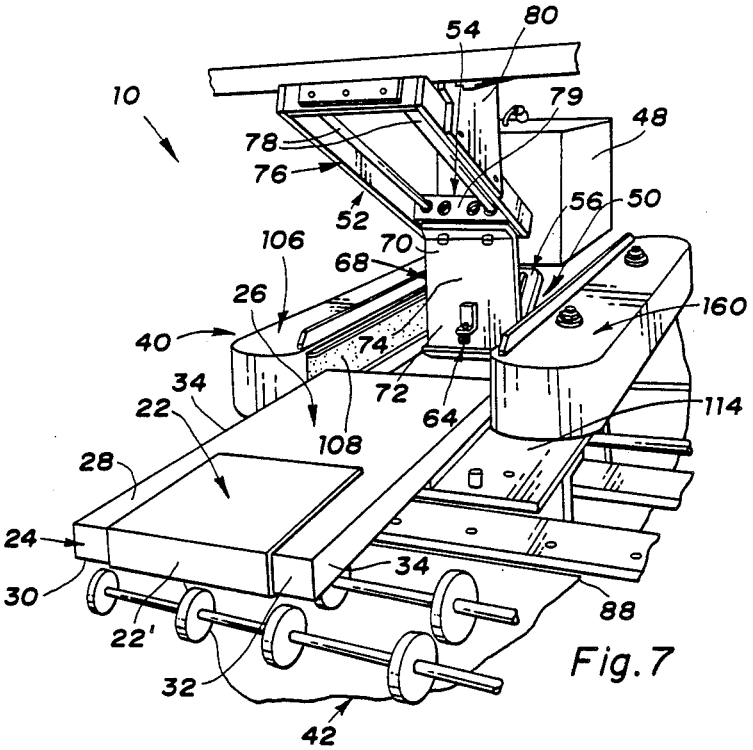
FIG. 7 is an end perspective view taken generally in the same direction as FIGS. 5 and 6 showing the labeled box onto an outfeed conveyor after the label applying operation.
Figure 8:
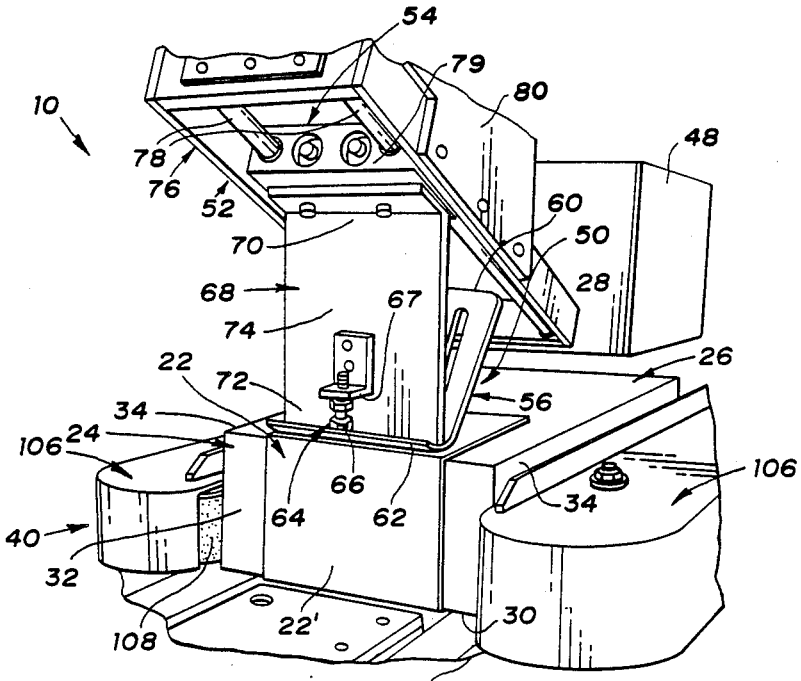
FIG. 8 is an end perspective view similar to FIG. 6 but illustrating the application of a label to a box of a different height which is permitted by the provision of the end presser mounted on the inclined support.
Figure 9:
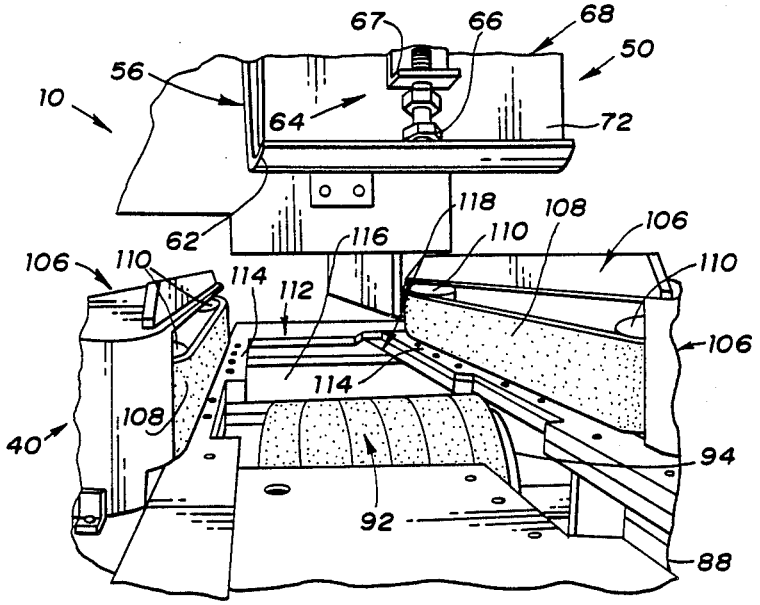
FIG. 9 is an end perspective view looking upstream with respect to the horizontal conveyor and illustrating laterally spaced conveyor sections of an operating conveyor that conveys the boxes during the label applying operation.
Figure 10:
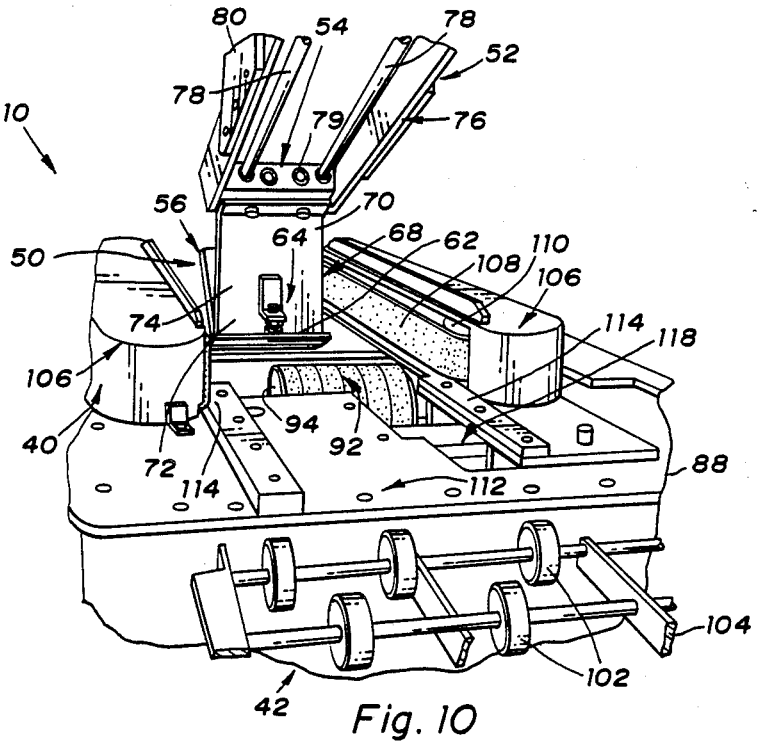
FIG. 10 is a view which is similar to FIG. 9 and also illustrates the outfeed conveyor which is located downstream from the spaced conveyor sections of the operating conveyor below the inclined support that mounts the end presser which presses the labels against each box end surface.

As best illustrated in FIGS. 7, 9, and 10, the operating conveyor 40 that moves the boxes during the label applying operation preferably includes a pair of laterally spaced conveyor sections 106 that are laterally adjustable to accommodate boxes of different widths. Each conveyor section 106 includes an endless conveyor loop 108 that is supported by a pair of drive pulleys 110 to drive the boxes by engagement thereof with the lateral sides of the boxes. Between the conveyor sections 106, the operating conveyor 40 also preferably includes a floor member 112 which has side portions 114 that support the lower side extremities of the boxes during the entire length of conveyance. Between these side portions 114, the floor member 112 has an opening 116 (FIGS. 5 and 9) that permits the label flap 22' to extend downwardly as illustrated in FIG. 5 in preparation for the pressing against the lower side surface by the presser roller 94 as previously described. One side portion 114 of the floor member 112 and its adjacent conveyor section 106, at the left as illustrated in FIGS. 9 and 10, are fixed with respect to the rest of the conveyor. The other floor side portion 114 and its adjacent conveyor section 106 are mounted by a slideway 118 (FIGS. 9 and 10) for lateral movement in order to permit the lateral adjustment for accommodating boxes of different widths.

It should also be appreciated that the adjustable mount 82 that permits vertical adjustment of the inclined support 52 illustrated in FIG. 1 also provides lateral adjustment thereof in any suitable manner so that the label can be applied to the center or any required lateral position on the box.

While the best mode for carrying out the invention has been described in detail, those familiar to the art to which this invention relates will recognize various alternative designs and embodiments for practicing the invention as defined by the following claims.

What is claimed is:

1. A label applier for applying labels to box ends having spaced side and end surfaces, the label applier comprising:

a horizontal conveyor for conveying the boxes horizontally while positioning the side surfaces thereof at upper and lower positions and one end surface thereof in a forward orientation with respect to the direction of conveyance;

a label dispenser for applying an adhesively secured label to the upper side surface of each box upon conveyance along the conveyor with a flap of the label extending forwardly from the box a predetermined distance;

an end presser for pressing the label flap against said one end surface of the box; and an inclined support that mounts the end presser for upward movement along the direction of box conveyance to permit the end presser to ride over the box after pressing the label against said one end surface.

2. A label applier as in claim 1 wherein the end presser includes a slide mounted by the inclined support and also includes a presser member having a pivotal connection for providing mounting thereof on the slide.

3. A label applier as in claim 2 wherein the presser member includes a curved foot that engages the upper side surface of the box as the end presser rides over the box after pressing the label flap against said one end surface.

4. A label applier as in claim 3 wherein the slide of the end presser includes a stop that positions the presser member in an inclined position in preparation for each label flap pressing operation and during the movement of the end presser over the box after the label flap pressing.

5. A label applier as in claim 4 wherein the stop includes an adjustable stop member for permitting adjustment of the degree of inclination of the presser member.

6. A label applier as in claim 5 wherein the slide of the end presser includes a vertically extending slide member having an upper end mounted by the inclined support, the slide having a lower end on which the presser member is pivotally mounted, and the slide also having an intermediate portion that mounts the adjustable stop member which is engaged by the curved foot of the presser member to control the inclination of the presser member.

7. A label applier as in claim 1 wherein the inclined support includes a vertically adjustable mount for adjusting the vertical position of the inclined support to thereby also adjust the vertical position of the end presser.

8. A label applier as in claims 1, 6 or 7 wherein the label dispenser applies the label to the upper side surface of the box with the label flap extending forwardly therefrom a greater distance than the height of said one end surface such that the label flap extends downwardly from the box after the end presser presses the label flap against said one end surface, and a lower presser for pressing the label flap against the lower side surface of the box after the pressing by the end presser.

9. A label applier as in claim 8 wherein the lower presser comprises a roller over which the box is conveyed.

10. A label applier as in claim 9 wherein the lower presser roller has a rotatable support that permits lateral adjustment of the roller.

11. A label applier as in claim 10 wherein the horizontal conveyor includes:

(a) an infeed conveyor that feeds the boxes to the label dispenser;

(b) an operating conveyor that conveys each box pas the label applier, the end presser, and lower presser roller; and (c) an outfeed conveyor that delivers the labeled box.

12. A label dispenser as in claim 11 wherein the operating conveyor includes a pair of laterally spaced conveyor sections that are laterally adjustable to accommodate boxes of different widths.

13. A label dispenser as in claim 12 wherein the pair of laterally adjustable conveyor sections each includes an endless conveyor loop that drives the box in the direction of conveyance.

14. A label applier for applying labels to box ends having spaced side and end surfaces, the label applier comprising:

a horizontal conveyor for conveying the boxes horizontally while positioning the side surfaces thereof at upper and lower positions and one end surface thereof in a forward orientation with respect to the direction of conveyance;

a label dispenser for applying an adhesively secured label to the upper side surface of each box upon conveyance along the conveyor with a flap of the label extending forwardly from the box a predetermined distance;

an end presser including a slide and a presser member pivotally mounted by the slide to press the label flap against said one end surface of the box; and an inclined support that mounts the slide of the end presser for upward movement along the direction of box conveyance to permit the end presser member to ride over the box after pressing the label against said one end surface.

15. A label applier for applying labels to box ends having spaced side and end surfaces, the label applier comprising:

a horizontal conveyor including an operating conveyor having a pair of laterally spaced conveyor sections for conveying the boxes horizontally while positioning the side surfaces thereof at upper and lower positions and one end surface thereof in a forward orientation with respect to the direction of conveyance;

a label dispenser for applying an adhesively secured label to the upper side surface of each box upon conveyance along the conveyor with a flap of the label extending forwardly from the box a predetermined distance;

an end presser including a slide and a presser member pivotally mounted by the slide to press the label flap against said one end surface of the box with the label flap extending downwardly therefrom;

an inclined support that mounts the slide of the end presser for upward movement along the direction of box conveyance to permit the end presser member to ride over the box after pressing the label against said one end surface; and a lower presser that presses the downwardly extending label flap against the lower side surface of the box after the presser member of the end presser presses the label flap against said one end surface.

* * * * *

UNITED STATES PATENT AND TRADEMARK OFFICE

CERTIFICATE OF CORRECTION

PATENT NO. : 4,950,351

DATED : August 21, 1990

INVENTOR(S) : William P. Young

It is certified that error appears in the above-identified patent and that said Letters Patent is hereby corrected as shown below:

Column 1, Line 16
after "apply" change "to" to --two--.

Column 2, Line 15
after "of" change "from" to --the box with the label flap extending forwardly therefrom--.

Column 7, Line 29, Claim 11
"pas" should be --past--.

Signed and Sealed this

Fifteenth Day of October, 1991

*Attest:*

HARRY F. MANBECK, JR.

*Attesting Officer*

*Commissioner of Patents and Trademarks*